United States Patent [19]

Schwarz

[11] Patent Number: 4,574,970

[45] Date of Patent: Mar. 11, 1986

[54] CAP FOR DRINKING CUPS

[76] Inventor: Helmut Schwarz, P.O. Box 1145, D-7972 I S N Y/Allgäu, Fed. Rep. of Germany

[21] Appl. No.: 577,347

[22] Filed: Feb. 6, 1984

[51] Int. Cl.[4] ..... A47G 19/22; B65D 47/06

[52] U.S. Cl. ..... 220/90.4; 220/90.2; 222/569; 604/78

[58] Field of Search ..... 220/90.2, 90.4, 90.6; 222/570, 569; D7/317, 10; D9/435, 447; 604/78

[56] References Cited

U.S. PATENT DOCUMENTS

| | | | |
|---|---|---|---|
| 2,608,841 | 9/1952 | Rice | 220/90.6 X |
| 2,627,735 | 2/1953 | Dexter | 220/90.2 |
| 2,765,639 | 10/1956 | Bryant | 220/90.4 |
| 3,085,710 | 4/1963 | McIlroy | 220/90.4 |
| 3,330,449 | 7/1967 | Bloomfield et al. | 222/570 X |
| 3,868,043 | 2/1975 | Freemyer | 220/90.4 |
| 4,146,157 | 3/1979 | Dixon, Sr. et al. | 220/90.4 X |
| 4,303,170 | 12/1981 | Panicci | 220/90.4 X |
| 4,441,623 | 4/1984 | Antoniak | 220/90.4 |
| 4,441,624 | 4/1984 | Sokolowski | 220/90.4 X |

FOREIGN PATENT DOCUMENTS

| | | | |
|---|---|---|---|
| 7731475 | 4/1978 | Fed. Rep. of Germany . | |
| 3118976 | 12/1982 | Fed. Rep. of Germany . | |
| 952781 | 11/1949 | France | 222/570 |

*Primary Examiner*—Allan N. Shoap

*Attorney, Agent, or Firm*—Kuhn Muller and Bazerman

[57] ABSTRACT

A cap for a drinking cup is provided with an integral lip resting hutch of elliptical shape adjacent the edge of the cap. The peripheral wall of the cap adjoining the hutch is elevated and curved outwards. The hutch bottom surface and the elevated peripheral wall outside surface form acute angles with one another. The cap enables a patient to drink in the natural manner closing a discharge opening in the hutch area by his upper lip.

9 Claims, 4 Drawing Figures

FIG.1
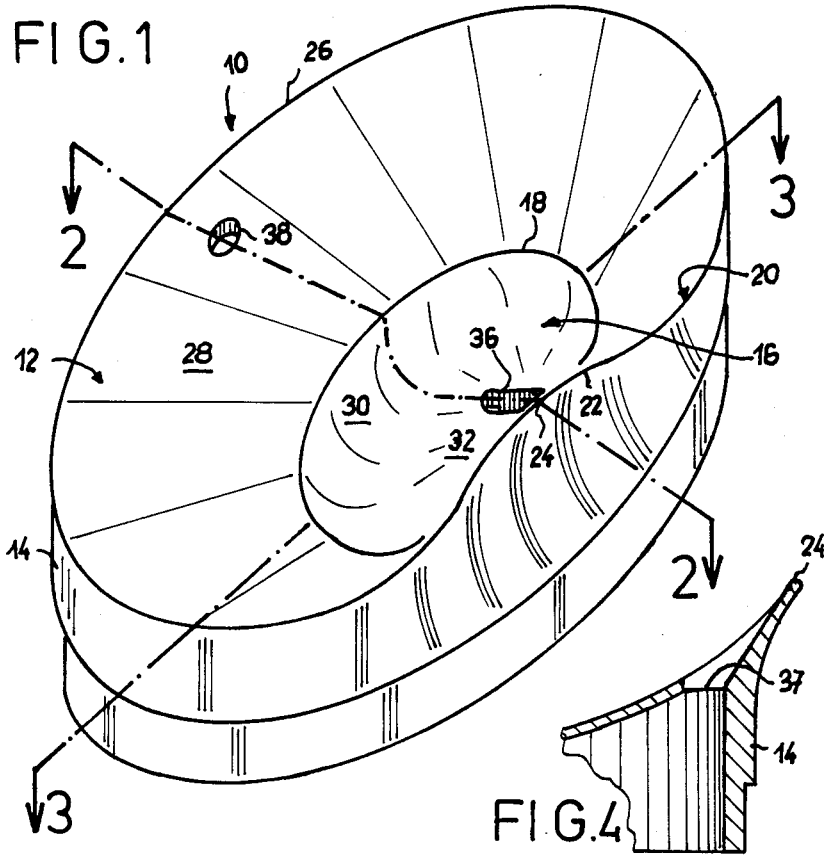
FIG.4
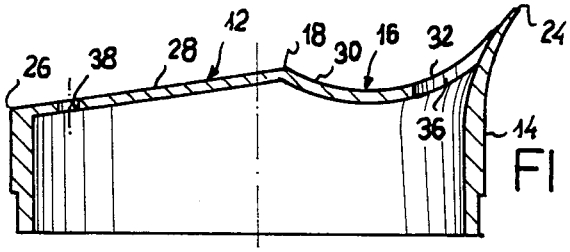
FIG.2
FIG.3
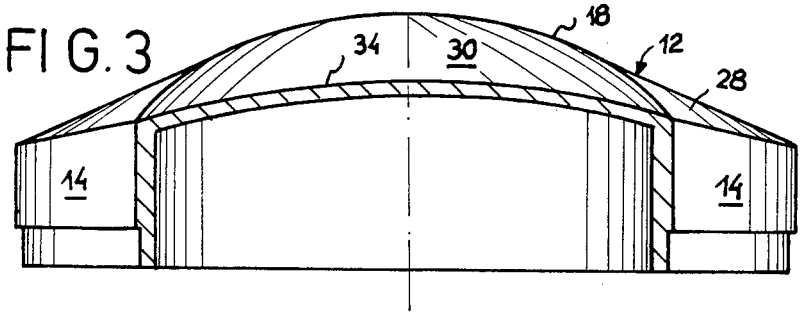

CAP FOR DRINKING CUPS

The invention relates to a cap for drinking cups, the cap comprising an upper wall, a downwardly extending peripheral wall and a discharge opening.

From the German Utility Model No. 77 31 475 a cap is known having an integral mouth piece extending upwards from the upper wall. The mouth piece is positioned near the peripheral wall of the cap. A plurality of discharge openings are provided in the upper end wall of the mouth piece. A patient encloses the mouth piece with his lips. He cannot regulate the liquid flow out of the cup by a conventional lip movement. The patient can swallow the wrong way.

From my German Patent Application No. 3 118 976 an improved cap is known which comprises an upwardly extending mouth piece the broadened end face thereof provided with the discharge opening forming a lip resting surface. No doubt the liquid flow can be regulated by the upper lip of the patient, but the lip resting surface is only small and the lips unnaturally must be pressed together to avoid a liquid escape at the corners of the mouth. Further according to experience a plurality of patients do not use the cap according to directions but enclose the whole mouth piece by their lips so that they will swallow the wrong way. Especially mentally disturbed patients do use the known cap contrary to the directions and in a few cases mouth pieces have been bitten off. Because the small mouth pieces can be swallowed the danger of smothering does exist.

Therefore it is one object of the invention to provide an improved cap for drinking cups which provides a foolproof handling and allows a regulation of the liquid flow by the upper lip of the patient.

Another object of the invention is to provide a novel cap which guarantees a safe sealing between the cap mouth piece configuration and the lips of the patient.

One further object is to provide a cap for drinking cups which cap is designed to allow only one single handling during the use thereof.

Last not least it is one object of the invention to provide a cap of novel configuration which allows the patient to drink using his natural movement of lips to stop the liquid discharge during swallowing.

These and other objects are accomplished by the invention in that a lip resting hutch is integrally formed in the upper wall at the outside surface thereof and offset in a direction from the center of the upper wall to the edge thereof, the lip resting hutch is arranged in one half of the upper wall and adjoining the edge of the upper wall along an edge portion longer than at least half of the longitudinal extension of the hutch as measured rectangularly to said offset direction, the height of the peripheral wall is increased in the adjoining region, the maximum height of the peripheral wall is situated substantially in a geometric vertical offset plane containing the centers of said upper wall and said hutch, the height of said peripheral wall reducing continuously from said maximum height in both directions symmetrically down to peripheral wall portions adjacent said adjoining region, the bottom surface of the hutch from the maximum depth rising continuously up to the edge of the peripheral wall in said offset plane, and said discharge opening is arranged within said offset plane between said edge and the center of the hutch.

Thanks to the fact, that the lip resting hutch forms an integral component or particle of the upper wall of the cap any false handling is avoided. The integration concept allows to form the lip resting hutch large enough to receive the whole upper lip of the patient up to his mouth corners. Also if the cap is awkwardly handled no liquid can flow out of the patient's mouth corners. One essential further advantage consists in that sealing of the discharge opening of the cap is effected by suction. Instead of pressing only an area of the upper lip on to a small end face of a mouth piece the whole upper lip of the patient is smoothly layed on the large area lip resting hutch, thereby during swallowing a small suction is produced providing the sealing. Therefore the patient can drink in the natural manner.

Further features and advantages of the invention can be gained from the following description, claims and the drawing which shows an preferred embodiment by way of example.

FIG. 1 shows a perspective view of a novel cap for a drinking cup;

FIG. 2 shows a cross-sectional view taken along line 2—2 of FIG. 1;

FIG. 3 shows a longitudinal section taken along line 3—3 of FIG. 1; and FIG. 4 shows a somewhat modified embodiment of the discharge channel in greater detail.

A cap 10 for a drinking cup consists of a one-part-article made of synthetic material and comprises an upper wall 12 and a downwardly extending peripheral wall 14, the lower edge of which being stepped for being insertable into the cup (not shown). A cap is preferably an elliptic shape. A lip resting hutch 16 is recessed in the upper wall 12. The hutch 16 is also of elliptic shape. The longitudinal extensions of the upper wall 12 and of the hutch 16 are parallel with one another. The center of the hutch 16 is offset from the center of the upper wall 12 perpendicularly to the longitudinal extension thereof so that the circumference 18 of the hutch 16 at least almost extends up to the upper edge 20 of the peripheral wall 14. For better explanation purposes the geometrical vertical plane which stands perpendicular on the horizontal plane of the lower edge of the peripheral wall 14 and which contains the centers of the upper wall 12 and the hutch 16 is marked as "offset plane". As mentioned before the edge 18 of the hutch 16 adjoins the upper edge 20 of the peripheral wall 14 and this adjoining area extends with an essential portion of the longitudinal extension of the hutch 16 along the upper edge 20 of the peripheral wall 14. The adjoining length should be at least half as great as the overall length of the hutch 16. The height of the peripheral wall 14 is increased in the adjoining area. The elevated course of the upper edge 20 of the peripheral wall 14 is designed with 22. The edge portion 22 has a wave-like shape and the highest point 24 thereof lies in the offset plane marked with 2—2 in FIG. 1. Beginning at this highest point 24 the edge portion 22 curves continuously downwards symmetrically in both directions and outwards from the adjoining area smoothly runs into the non-elevated edge portion 26 of the upper edge 20.

The transverse dimension of the hutch 16 measured in the offset plane is substantially half as great as the corresponding dimension of the upper wall 12 so that the whole lip resting hutch 16 lies within one longitudinal half of the upper wall 12. Also the length of the hutch 16 is substantially half as great as the length of the upper wall 12.

The non-elevated upper edge 26 of the peripheral wall 14 lies in a horizontal plane which is substantially on the same level as the central portion of the hutch 16. Therefore the hutch-free area 28 of the upper wall 12 ascends from the edge portion 26 on to the dge 18 of the hutch 16. This ascending portion 28 of the upper wall 12 forms a conicallike surface. In the cross-section of FIG. 2 this surface 28 forms an inclined straight line. At the end of this ascending upper wall portion 28 the hutch 16 begins with an descending concave area 30 which continuously runs into an ascending area 32 which extends up to the elevated edge 22 of the peripheral wall 14. The ascending area 32 of the hutch 16 and the outside surface of the elevated peripheral wall 14 form acute angles with one another at the edge 22 along an edge portion which almost has the same length as the hutch 16. The surface of the ascending area 32 of the hutch 16 adjacent to the edge 22 is formed by concavely curved lines, straight lines or even convex lines in cross-section.

While at least the central surface portion of the hutch 16 in cross-section is concave in longitudinal direction it is convex as shown at 34 in FIG. 3. Although a straight line course of the central surface portion would be possible by the convex shape of this central portion and of the ascending area 32 a better adaption to the anatomical shape of the upper lip is achieved.

The peripheral wall 14 in the non-elevated portion is substantially cylindrical, that means vertically arranged, but in the elevated portion at least the upper area thereof is curved outwardly so that the highest edge point 24 lies outwards of the bottom contour of the peripheral wall 14. The outside surface of the peripheral wall 14 adjacent to the edge 22 therefore is convexly curved in peripheral direction and concavely curved in the axial cross-section 2—2.

A discharge opening 36 is provided in the ascending area 32 of the hutch 16. The opening 36 forms a slot beginning at a point leaving a small interspace with the highest edge point 24 and in the offset plane 2—2 running down at least almost to the center of the hutch 16. Oppositely arranged with respect to this opening 36 is an air inlet hole 38. According to FIG. 4 an opening 37 substantially of circular cross-section is provided in the upper wall 12 the circumference thereof contacting the inside periperal surface of the peripheral wall 14. A slot-like channel is formed in the hutch area 32 communicating at its lower end with the opening 37 and extending upwards in the direction of the highest edge point 24 but ending there before. The depth of the channel reduces continuously in upward direction down to the amount zero. Therefore the upper lip contacting the hutch surface 32 closes the opening 37 and the discharge channel hermetically.

I claim:

1. A cap for a drinking cup comprising:

(a) a peripheral wall, in cross-section, extending in a vertical plane, having attachment means at the lower part of said peripheral wall for attaching to a drinking cup;

(b) a top wall transversely extending over the peripheral wall, said top wall extending in substantially one plane from one side of said peripheral wall and merging into a lip resting hutch at the opposing side of the top wall, said lip resting hutch comprising a depression below said plane spaced inwardly from said peripheral wall on the side thereof opposite said one side, said depression extending toward said opposite side and ascending upwardly above said plane and defining an extension offset radially outwardly from said vertical plane, said lip resting hutch including a discharge opening located in said depression adjacent to that part of said hutch ascending upwardly, said opening being spaced axially downwardly and radially inwardly from the uppermost edge of said extension.

2. A cap as claimed in claim 1, wherein the outside surface of the peripheral wall is concavely curved in that part of said cap defining the extension offset outwardly from said vertical plane.

3. A cap as claimed in claim 1, wherein the top wall ascends gradually from said one side of the peripheral wall to the edge of the depression in said top wall.

4. A cap as claimed in claim 1, wherein the surface of the depression in said top wall is concavely curved in the direction extending toward said opposite side and convexly curved in the direction transverse thereto.

5. A cap as claimed in claim 1, wherein the lip resting hutch has an elliptical contour and the longitudinal axis thereof forms right angles with a vertical plane extending radially inwardly from the uppermost edge of said extension.

6. A cap as claimed in claim 1, wherein the discharge opening comprises a flow channel which is bisected by a vertical plane extending radially inwardly from the uppermost edge of said extension.

7. A cap as claimed in claim 6, wherein the flow channel has its maximum depth at the channel end in said depression adjacent to that part of the hutch ascending upwardly and wherein the channel depth continuously reduces to the other channel end which is spaced inwardly from the uppermost edge of the extention.

8. A cap as claimed in claim 1, wherein the circumference of the discharge opening at least substantially contacts the inside contour of the peripheral wall on the side thereof opposite said one side.

9. A cap as claimed in claim 1, wherein the hutch surface adjoining the uppermost edge of said extension forms acute angles with said peripheral wall.

* * * * *